US006796230B2

(12) United States Patent
Pichler et al.

(10) Patent No.: US 6,796,230 B2
(45) Date of Patent: Sep. 28, 2004

(54) SELF-INKING STAMP

(75) Inventors: Wolfgang Pichler, Wels (AT); Peter Zindl, Obertraun (AT)

(73) Assignee: Trodat GmbH, Wels (AT)

( * ) Notice: Subject to any disclaimer, the term of this patent is extended or adjusted under 35 U.S.C. 154(b) by 68 days.

(21) Appl. No.: 10/030,724

(22) PCT Filed: Apr. 12, 2001

(86) PCT No.: PCT/AT01/00110

§ 371 (c)(1),
(2), (4) Date: Jan. 8, 2003

(87) PCT Pub. No.: WO01/85462

PCT Pub. Date: Nov. 15, 2001

(65) Prior Publication Data

US 2004/0144274 A1 Jul. 29, 2004

(30) Foreign Application Priority Data

May 11, 2000 (AT) ..... GM349/2000

(51) Int. Cl.[7] ..... B41K 1/42

(52) U.S. Cl. ..... 101/334; 101/333; 101/327

(58) Field of Search ..... 101/334, 333, 101/405, 406, 327, 104

(56) References Cited

U.S. PATENT DOCUMENTS

| | | | | | |
|---|---|---|---|---|---|
| 4,432,281 | A | * | 2/1984 | Wall et al. | 101/334 |
| 4,676,162 | A | * | 6/1987 | Phipps, Sr. et al. | 101/405 |
| 5,152,223 | A | * | 10/1992 | Mairon | 101/334 |
| 5,505,130 | A | * | 4/1996 | Winston | 101/333 |
| 5,623,875 | A | | 4/1997 | Perets | 101/334 |
| 5,649,485 | A | | 7/1997 | Dour et al. | 101/334 |
| 5,974,969 | A | * | 11/1999 | Okumura et al. | 101/327 |
| 6,047,639 | A | * | 4/2000 | Shih | 101/333 |
| 6,360,661 | B1 | * | 3/2002 | Cheung | 101/333 |

* cited by examiner

*Primary Examiner*—Eugene H. Eickholt
(74) *Attorney, Agent, or Firm*—Karl Hormann

(57) ABSTRACT

A self-inking stamp with a stamp pad disposed in a container movably retained in a shaft in the frame of the stamp. To prevent the insertion into the shaft of non-genuine stamp pads the shaft and container are respectively provided with complementary keying features. In a preferred embodiment the keying feature consists of matching grooves and protrusions in the shaft and container, respectively.

6 Claims, 1 Drawing Sheet

SELF-INKING STAMP

BACKGROUND OF THE INVENTION

1. Field of the Invention

The invention relates to a top dyeing self-inking stamp with a bottom section to be placed on a surface to be stamped, an ink pad arranged in a container adapted to be inserted for replacement into a receiving shaft, a flipping mechanism for a stamp platen disposed in the bottom section for flipping reciprocal movement and an actuator movable against the bias of a spring relative to the bottom section.

2. The Prior Art

Such stamps are provided with ink pads which usually are inserted horizontally into a receiving shaft of the stamp. It has been found that ink pads of generally lower quality fabricated by third parties are being marketed as replacement ink pads which fit into the shaft designed for the original ink pad. This, however, leads to an overall reduction in the quality of the imprint and of the stamp and to the reputation of the product.

OBJECT OF THE INVENTION

It is an object of the invention to structure the ink pad and the receiving shaft such that it is difficult and preferably impossible to insert third party pads.

SUMMARY OF THE INVENTION

In accordance with the invention, this is accomplished by the ink pd container being provided in its upper surface with at least one groove extending in the insertion direction for form-fitting engagement by a rib disposed at the upper surface of the receiving shaft.

Preferably, several spaced grooves as well as several commensurately spaced ribs are provided.

In accordance with another embodiment of the invention the rib or ribs extend only across a portion of the length of the insertion stroke of the ink pad container.

Such a structure renders insertion of a non-fitting pad impossible.

In accordance with another preferred embodiment of the invention, the groove or grooves and the rib or ribs are of substantially semi-circular cross-section; they may, however, be of a different cross-section, e.g., triangular.

DESCRIPTION OF THE DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DESCRIPTION OF THE PREFERRED EMBODIMENT

Figure 2:
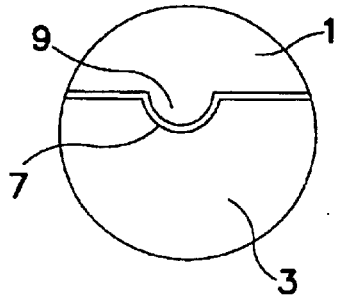
FIG. 2 is a detail of FIG. 1.
Figure 1:
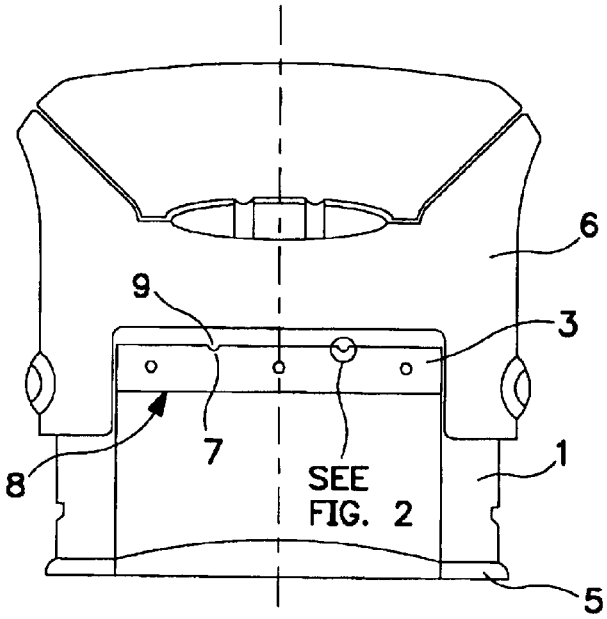
FIG. 1 is a view of the stamp in accordance with the invention.
Figure 4:
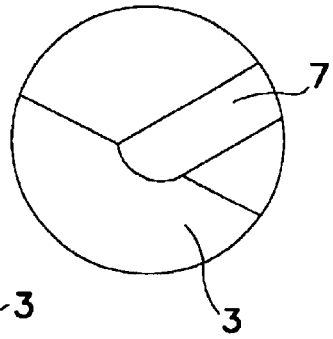
FIG. 4 is a detail if FIG. 2.

The depicted self-inking stamp is provided with a bottom section 1 to be placed on a surface to be stamped, an ink pad

2 arranged in a container 3 which may slidingly be horizontally inserted in the direction of arrow F into a receiving shaft 8 of the bottom section 1. The bottom section 1 is provided with a flipping mechanism 4 for a stamp platen (not shown) reciprocally movable and pivotable between the ink pad 2 and a support frame 5. Furthermore, the stamp is provided with an actuator upper section 6 slidable relative to the bottom section 1 against the bias of a spring (not shown) seated on a spring support 10. The actuator 6 embraces the bottom section 1 and is connected therewith.

Figure 3:
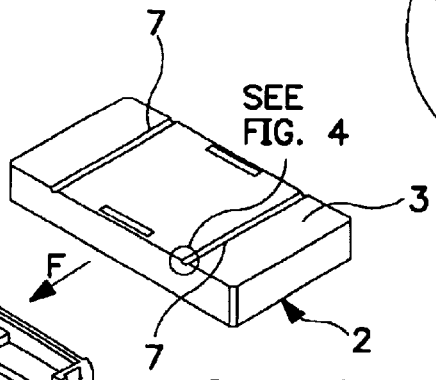
FIG. 3 is a perspective view of an ink pad.
Figure 5:
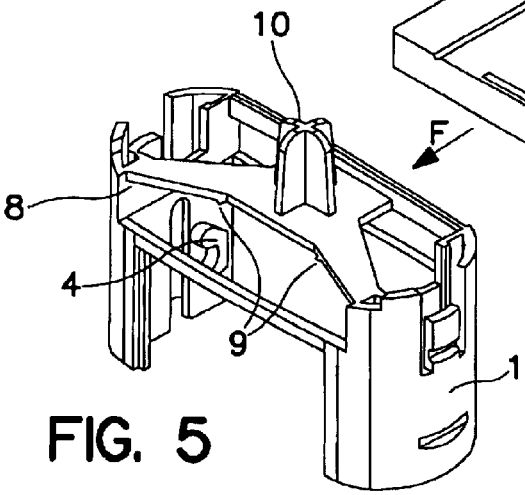
FIG. 5 is a perspective view of the bottom section of the stamp.

As shown in FIG. 3, the ink pad container 3 is provided at its upper surface, extending in the direction F of insertion, with two grooves 7 form-fittingly to be engaged by ribs 9 provided at the upper surface of the receiving shaft 8 and extending for only a portion of the length of insertion of the ink pad container 3. In the embodiment shown, the grooves 7 and the ribs 9 are of substantially semi-circular cross-section.

It is within the scope of the invention to provide more than two grooves 7, for instance, and, preferably, several appropriately spaced ribs 9.

It will be understood that within the concept of the invention the depicted embodiment may be altered in different ways, particularly as to number and shape of ribs and grooves.

What is claimed is:

1. A self-inking stamp, comprising:

a substantially parallelepiped frame having at one end thereof a substantially shaft formed by a parallelepiped arrangement of substantially flat surface members for receiving by sliding movement a container with a stamp pad therein and at an end opposite the one end a web defining an opening disposed substantially parallel to the shaft;

a stamp platen;

an actuator movable against the bias of a spring from a rest position to a second position;

a swivel mechanism supporting the stamp platen and connected to the actuator for moving the platen from a first position of engaging the stamp pad to a second position within the opening;

an elongated groove disposed in at least one of the surface members and the container and extending in the direction of sliding movement of the container; and a protrusion in the other of the at least one surface member and container disposed to be received in the groove during sliding movement of the container.

2. The stamp of claim 1, wherein there is provided a second groove disposed in parallel to the first groove and a second protrusion disposed to be received in the second groove.

3. The stamp of claim 1, wherein the protrusion is an elongated rib.

4. The stamp of claim 3, wherein the length of the rib is less than the length of the groove.

5. The stamp of claim 1, wherein the groove and the protrusion are of substantially complementary cross-section.

6. The stamp of claim 5, wherein the cross-section is substantially semi-circular.

* * * * *